United States Patent [19]

Kühnert

[11] 4,448,044

[45] May 15, 1984

[54] SLIDER NEEDLE

[75] Inventor: Gottfried Kühnert, Aalen, Fed. Rep. of Germany

[73] Assignee: Universal Maschinenfabrik Dr. Rudolf Schieber GmbH & Co., KG, Westhausen, Fed. Rep. of Germany

[21] Appl. No.: 450,696

[22] Filed: Dec. 17, 1982

[30] Foreign Application Priority Data

Dec. 23, 1981 [DE] Fed. Rep. of Germany ..... 3151225

[51] Int. Cl.[3] ..... D04B 35/04

[52] U.S. Cl. ..... 66/120

[58] Field of Search ..... 66/120

[56] References Cited

U.S. PATENT DOCUMENTS

| | | | |
|---|---|---|---|
| 51,577 | 12/1865 | Fifield | 66/120 |
| 1,673,634 | 6/1928 | Page | 66/120 |
| 3,828,582 | 8/1974 | Widdowson et al. | 66/120 |
| 4,043,153 | 8/1977 | Lindner et al. | 66/120 |
| 4,109,490 | 8/1978 | Bosch | 66/120 |

FOREIGN PATENT DOCUMENTS

| | | |
|---|---|---|
| 4031 | 10/62 | Fed. Rep. of Germany. |
| 1635963 | 1/77 | Fed. Rep. of Germany. |
| 2320789 | 3/73 | Fed. Rep. of Germany. |

*Primary Examiner*—Ronald Feldbaum

*Attorney, Agent, or Firm*—Sughrue, Mion, Zinn, Macpeak and Seas

[57] ABSTRACT

A slider needle for knitting machines, particularly flat knitting machines, comprises a needle body with needle hook and needle butt, and a slider with a slider butt and mounted to be displaceable relative to the needle body. In order to produce a slider needle of simple construction with the needle butt capable of being depressed into the needle bed, the needle body consists of a guide shaft provided with a slot for receiving and guiding the slider and a flexible shaft extending from the guide shaft and projecting rearwardly from the guide shaft towards the needle butt, with the flexible shaft carrying the needle butt and being engageable from below in the needle channel by a tilting lever.

6 Claims, 3 Drawing Figures

SLIDER NEEDLE

FIELD OF THE INVENTION

This invention relates to a slider needle for knitting machines, particularly flat knitting machines, comprising a needle body with needle hook and needle butt and a slider equipped with a slider butt and mounted to be displaceable relative to the needle body.

Various different types of needle are known for use on textile machines to create stitches. These include, for example, point needles, latch needles and slider needles.

For flat knitting machines it has been conventional until now to use latch needles. However, latch needles have the disadvantage that the latch is a loose, freely movable element which is held in the desired position or is brought into the desired position with the aid of brushes, magnets, latch openers in the form of hooks or plates and latch closers. Because of the length of the latches, which for stitch considerations must be commensurate with the height of the needle hooks, relatively large needle paths have to be covered in the formation of stitches, when making tuck stitches and in the transfer of stitches. The length of the needle path for its part determines the size of the cam elements, and consequently the size of the knitting and transfer jacks and the size and the weight of the carriage.

The use of slider needles would indeed considerably reduce the needle paths, since the needle head is automatically controlled by the slider and is opened and closed with small needle movements and only has to be open during the laying of the yarn, remaining closed for the rest of the time. For needles with needle butts which are depressed into the needle bed for the selection of needles it has however, until now, required a too complex construction of slider needle, so that the slider needle has not found favour in the flat knitting art.

SUMMARY OF THE INVENTION

It is an object of the present invention to create a slider needle of the type first referred to above which has a needle butt which can be depressed into the needle bed, which is simple in construction and which is reliable in operation.

This is achieved in accordance with the present invention in that the needle body comprises a guide shaft having a slot for receiving and guiding the sliding and a flexible shaft which extends from the guide shaft and projects rearwardly from the guide shaft towards the needle butt, with the flexible shaft carrying the needle butt and being engageable from below in the needle channel by a tilting lever.

By this means one achieves a very simple construction of slider needle, and in a manner which not only enables one to reduce the weight of the carriage and the width of the needle bed, but also considerably to increase the operating speed of the knitting machine in comparison with knitting machines which use latch needles.

The flexible shaft may partially overlap the guide shaft below the guide shaft.

The flexible shaft is preferably cranked upwardly to the rear of the guide shaft in such a way that the slider abuts against the cranked portion when the needle hook is open. Alternatively, a stop pin can be provided extending transversely to the guide shaft and against which the rearward end of the slider abuts when the needle hook is open. In these embodiments the slider is entrained automatically upon outward extension movement of the needle body, and the needle body is entrained automatically upon retraction of the slider.

The guide shaft and the slider are preferably held in the needle bed by means of a bar which extends above the guide shaft and along the length of the needle bed. Additionally, when the guide shaft and flexible shaft are arranged to overlap, a bar is preferably provided extending along the length of the needle bed between the guide shaft and flexible shaft in order to limit upward movement of the flexible shaft and to support the guide shaft for sliding movement thereon.

BRIEF DESCRIPTION OF THE DRAWINGS

Preferred embodiments of needle in accordance with the invention will now be described by way of example and with reference to the accompanying drawing. In the drawing.

DESCRIPTION OF THE PREFERRED EMBODIMENT

Figure 1:
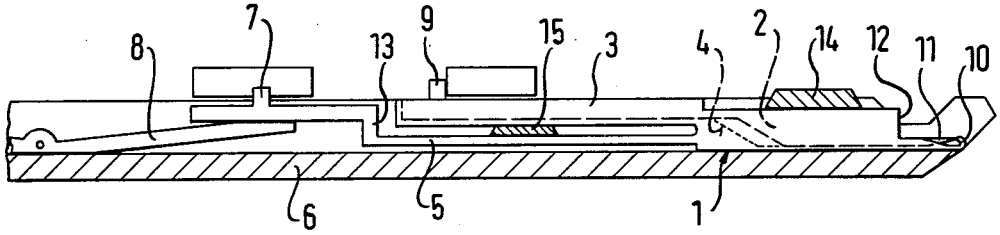
FIG. 1 shows a first embodiment of slider needle in accordance with the present invention mounted in the needle bed with the needle hook closed by the slider.
Figure 2:
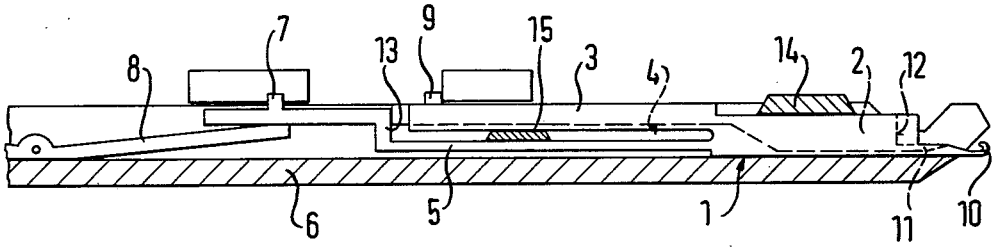
FIG. 2 shows the slider needle of FIG. 1 with the needle hook open; and, FIG. 3 shows a second embodiment of slider needle in accordance with the present invention, positioned in the needle bed with the needle hook open.

The slider needle shown in FIGS. 1 and 2 comprises a needle body 1 and a slider 2. The needle body 1 comprises a guide shaft 3 having a slot 4 for receiving and guiding the slider 2, and also a flexible shaft 5 formed as an extension to the guide shaft 3 and partly overlapping the guide shaft 3 from below. The needle body 1 is mounted for sliding movement in the needle bed 6. The flexible shaft 5 is provided with a needle butt 7 which can be engaged by a cam element on the carriage when the flexible shaft 5 is selectively pushed upwards against its own spring action by a tilting lever 8. The slider 2 has a slider butt 9 towards its rear end and, towards its front end, has both a tongue 11 which can close the needle hook 10 of the needle body 1 and also a stitch support 12. The flexible shaft 5 is cranked upwards to the rear of the guide shaft 3 in such a way that the slider 2 abuts against an upward cranked portion 13 of the flexible shaft when the needle hook 10 is open. In this way the slider 2 is moved automatically upon outward extension of the needle body 1 and the needle body 1 is moved automatically upon retraction of the slider 2.

The guide shaft 3 and the slider 2 are held within the needle bed 6 by means of a bar 14 which extends above the guide shaft 3 and along the needle bed. Between the guide shaft 3 and the flexible shaft 5 there is provided a further bar 15 which extends along the needle bed 6. This second bar 15 on the one hand supports the guide shaft 3 and on the other hand limits the resilient upward movement of the flexible shaft 5.

Figure 3:
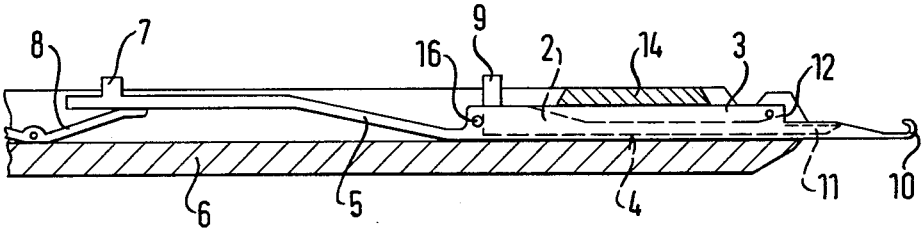

FIG. 3 shows a second embodiment of slider needle in accordance with the present invention. This slider needle differs from the slider needle shown in FIGS. 1 and 2 essentially in that the flexible shaft 5 extends upwards and backwards from the guide shaft 3 towards the needle butt 7 without the guide shaft 3 partially overlapping the flexible shaft. A stop pin 16 is provided transversely to the guide shaft 3 and against which the rearward end of the slider 2 engages when the needle hook 10 is open, instead of it engaging against a cranked portion of the flexible shaft as in FIGS. 1 and 2.

I claim:

1. A slider needle for knitting machines, particularly flat knitting machines, comprising a needle body with needle hook and needle butt, and a slider with a slider butt mounted to be displaceable relative to the needle body, the needle body comprising a guide shaft having a slot for receiving and guiding the slider and a flexible shaft extending from the guide shaft and projecting rearwardly from the guide shaft towards the needle butt, and the flexible shaft carrying the needle butt being engageable from below in the needle channel by a tilting lever.

2. A slider needle in accordance with claim 1, in which the flexible shaft partially overlaps the guide shaft below the guide shaft.

3. A slider needle in accordance with claim 1 in which the flexible shaft is cranked upwardly to the rear of the guide shaft in such a manner that the slider abuts the cranked portion when the needle hook is open.

4. A slider needle in accordance with claim 1 in which a stop pin is provided transversely to the guide shaft and the rearward end of the slide is arranged to abut against the stop pin when the needle hook is open.

5. A slider needle in accordance with claim 1 in which the guide shaft and the slider are held in the needle bed by a bar which extends along the needle bed above the guide shaft.

6. A slider needle in accordance with claim 2 in which a bar extending along the needle bed is provided between the guide shaft and the flexible shaft.

* * * * *